US006326722B1

(12) United States Patent
Shimizu et al.

(10) Patent No.: US 6,326,722 B1
(45) Date of Patent: Dec. 4, 2001

(54) COLOR CATHODE-RAY TUBE

(75) Inventors: Norio Shimizu; Takuya Mashimo, both of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/433,736

(22) Filed: Nov. 4, 1999

(30) Foreign Application Priority Data

Nov. 5, 1998 (JP) ..... 10-314547

(51) Int. Cl.[7] ..... H01J 29/07
(52) U.S. Cl. ..... 313/402; 313/408
(58) Field of Search ..... 313/402, 408

(56) References Cited

U.S. PATENT DOCUMENTS 4,697,119 * 9/1987 Inoue et al. ..... 313/402 X
5,155,410 * 10/1992 Wakasono et al. ..... 313/402
5,416,379 * 5/1995 Inoue et al. ..... 313/402

FOREIGN PATENT DOCUMENTS

0174852 * 3/1986 (EP) ..... 313/402
10-199417 7/1998 (JP) .

* cited by examiner

*Primary Examiner*—Ashok Patel
(74) *Attorney, Agent, or Firm*—Oblon, Spivak, McClelland, Maier & Neustadt, P.C.

(57) ABSTRACT

A shadow mask has a mask body and a substantially rectangular mask frame attached to a peripheral portion of the mask body. The mask body has a substantially rectangular curved effective surface opposed to a phosphor screen formed on an inner surface of a panel. The effective surface has a number of electron beam passage apertures. The effective surface of the mask body has a curvature in a direction of the long axis, which is set within a range of about 0 to $2\times10^{-4}$ (1/mm) over an area from a center of the effective surface to a middle portion of the effective surface in the direction of the long axis. A curvature at a peripheral portion in the direction of the long axis is set to be greater than that at the middle portion. A curvature on the short axis in the direction of the short axis successively increases over a distance equal to at least two thirds of a distance between the center and an effective end of the short axis.

12 Claims, 4 Drawing Sheets

COLOR CATHODE-RAY TUBE

BACKGROUND OF THE INVENTION

The present invention relates to a color cathode-ray tube having a shadow mask.

In general, a color cathode-ray tube (CRT) has a vacuum envelope. The vacuum envelope comprises a substantially rectangular panel, which has a substantially rectangular effective portion with a curved surface and a skirt portion provided on a peripheral area of the effective portion, and a funnel coupled to the skirt portion of the panel. A phosphor screen is formed on an inner surface of the effective portion of the panel. The phosphor screen includes black non-light emission layers and striped tricolor phosphor layers interposed among the non-light-emission layers. A substantially rectangular shadow mask is disposed inside the phosphor screen so as to face the phosphor screen. On the other hand, an electron gun for emitting three electron beams is disposed within a neck of the funnel.

In the color CRT, three electron beams emitted from the electron gun are deflected by magnetic fields generated by a deflecting device mounted on an outer surface of the funnel. The deflected beams are horizontally and vertically scanned over the phosphor screen through the shadow mask. Thus a color image is displayed.

The shadow mask serves to selectively pass the three electron beams from the electron gun in association with the tricolor phosphor layers. The shadow mask comprises a substantially rectangular mask body and a substantially rectangular mask frame. The mask body has a curved effective surface opposed to the phosphor screen, and a number of electron beam passage apertures are formed in the curved effective surface. The mask frame is attached to a peripheral portion of the mask body. The shadow mask is detachably supported within the panel by engaging wedge-shaped elastic support members attached to the respective corner portions of the mask frame with stud pins fixed to the respective corner portions of the skirt portion of the panel.

In general, in order to display an image without color blur on the phosphor screen of the color CRT, it is necessary to selectively pass the three electron beams through the electron beam passage apertures in the mask body so that the electron beams may exactly land on the associated tricolor phosphor layers. For this purpose, it is also necessary to exactly determine the positional relationship between the panel and the shadow mask and, in particular, to maintain a distance (value q) between the inner surface of the effective portion of the panel and the effective surface of the mask body within a predetermined tolerable range.

In modern color CRTs, in order to enhance visibility and reduce reflection of external light, it is desired that the curvature of the outer surface of the effective portion of the panel be decreased (i.e. the radius curvature be increased) to a level of a substantial flat plane. In the case of this type of panel, the curvature of the inner surface of the effective portion needs to be decreased from the standpoint of manufacture of the vacuum envelope and visibility. In addition, with an increase in radius of curvature of the inner surface of the effective portion, the curvature of the effective surface of the mask body also needs to be decreased to achieve exact beam landing.

If the curvature of the effective surface of the mask body is decreased, however, the curved-surface retention strength decreases and the mask body may deform in the manufacturing process of the color CRT.

In a color CRT, because of the operational principle, the amount of portions of electron beams, which pass through the electron beam passage apertures in the shadow mask and reach the phosphor screen, is less than ⅓ of the entire amount of electron beams emitted from the electron gun. The other portions of electron beams collide with those parts of the shadow mask which are other than the electron beam passage apertures and are converted to thermal energy to heat the shadow mask. Consequently, the shadow mask thermally expands and doming towards the phosphor screen occurs.

If the distance between the phosphor screen and the effective surface of the mask body decreases to a level out of the predetermined permissible range due to the doming, an error will occur in positions of beam landing on the tricolor phosphor layers and color purity will deteriorate. The magnitude of displacement of beam landing due to thermal expansion of the shadow mask varies greatly depending on the luminance of an image pattern and the duration of the pattern. In particular, when a high-luminance image pattern is locally displayed, local doming will occur and a great displacement of beam landing will locally occur in a short time.

It is well known that where the curvature of a mask body is decreased, local doming will increase. In this case, too, local displacement of beam landing will occur and the color purity deteriorate.

Japanese Patent Application No. 10-199417 discloses a technique for correcting a displacement of beam landing in a case where the curvature of the mask body is decreased, as described above. According to this technique, a color CRT has a flattened outer surface of a panel whose curvature is substantially zero. The color CRT also has a shadow mask with a mask body whose effective surface has such a cylindrically curved shape that the curvature in its long axis is substantially zero and that in its short axis is fixed at a constant value.

With use of such a curved surface, the problem of doming of the shadow mask can almost be solved. However, the curved-surface retention strength of this shadow mask is inadequate, and the problem of deterioration in color purity due to deformation of the shadow mask remains to be solved.

BRIEF SUMMARY OF THE INVENTION

The present invention has been made in consideration of the above circumstances, and its object is to provide a color cathode-ray tube capable of reducing deterioration in color purity due to doming of a shadow mask at the time of operation of the color cathode-ray tube having a panel, whose outer surface is so set as to enhance visibility and reduce reflection of external light, or due to deformation of a mask body in a manufacturing process of the color cathode-ray tube.

In order to achieve the object, there is provided a color cathode-ray tube comprising: a vacuum envelope having a panel with a substantially rectangular effective portion; a phosphor screen formed on an inner surface of the effective portion; and a substantially rectangular shadow mask arranged to face the phosphor screen, wherein the shadow mask has a mask body and a substantially rectangular mask frame attached to a peripheral portion of the mask body, the mask body having a substantially rectangular curved effective surface opposed to the phosphor screen, and a number of electron beam passage apertures being formed in the effective surface.

The shadow mask and the panel both have a center through which a tube axis extends, and a long axis and a short axis extending through the center at right angles with each other.

The effective surface of the mask body has a curvature in a direction of the long axis, which is set within a range of about 0 to $3\times10^{-4}$ (1/mm) over an area from the center of the effective surface to a middle portion of the effective surface in the direction of the long axis, a curvature at a peripheral portion in the direction of the long axis is set to be greater than that at the middle portion, and a curvature on the short axis in the direction of the short axis successively increases over a distance equal to at least two thirds of a distance between the center and an effective end of the short axis.

Where a radius of curvature in the direction of the long axis near the center of the effective surface is RmHC, a radius of curvature in the direction of the short axis (Y) is RmVC and a radius of curvature in the direction of the short axis of the effective surface near the effective end of the short axis (Y) is RmVP, the effective surface of the mask body is curved to satisfy the following relationships:

$$O<RmVP/RmVC<0.6$$

$$RmVC/RmHC<0.8$$

Preferably, the effective surface is curved such that RmHC, RmVC and RmVP satisfy the following formulae:

$$O<RmVP/RmVC<0.4$$

$$RmVC/RmHC<0.3$$

According to the color cathode-ray tube of this invention, the inner surface of the effective portion of the panel has a curvature in a direction of the long axis, which is set within a range of about 0 to $3\times10^{-4}$ (1/mm) over an area from the center of the effective portion to a middle portion of the effective portion in the direction of the long axis, a curvature at a peripheral portion in the direction of the long axis is set to be greater than that at the middle portion, and a curvature on the short axis in the direction of the short axis successively increases over a distance equal to at least two thirds of a distance between the center and an effective end of the short axis.

Where a radius of curvature in the direction of the long axis near the center of the effective portion is RpHC, a radius of curvature in the direction of the short axis is RpVC and a radius of curvature in the direction of the short axis near the effective end of the short axis is RpVP, the inner surface of the effective portion of the panel is curved such that RpHC, RpVC and RpVP satisfy the following formulae:

$$O<RpVP/RpVC<0.6$$

$$RpVC/RpHC<0.8$$

Preferably, the inner surface of the effective portion is curved such that RpHC, RpVC and RpVP satisfy the following formulae:

$$O<RpVP/RpVC<0.4$$

$$RpVC/RpHC<0.3$$

According to the color cathode-ray tube with the above structure, the curvatures in the directions of the long and short axes of the effective surface of the mask body are set as described above. Thereby, a high-quality image can be displayed on the phosphor screen, and deterioration in color purity due to doming of the shadow mask can be reduced. At the same time, deformation of the mask body in the manufacturing process of the color cathode-ray tube can be reduced, and deterioration in color purity due to a beam landing error can be decreased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode-ray tube (CRT) according to an embodiment of the present invention will now be described in detail with reference to the accompanying drawings.

Figure 1:
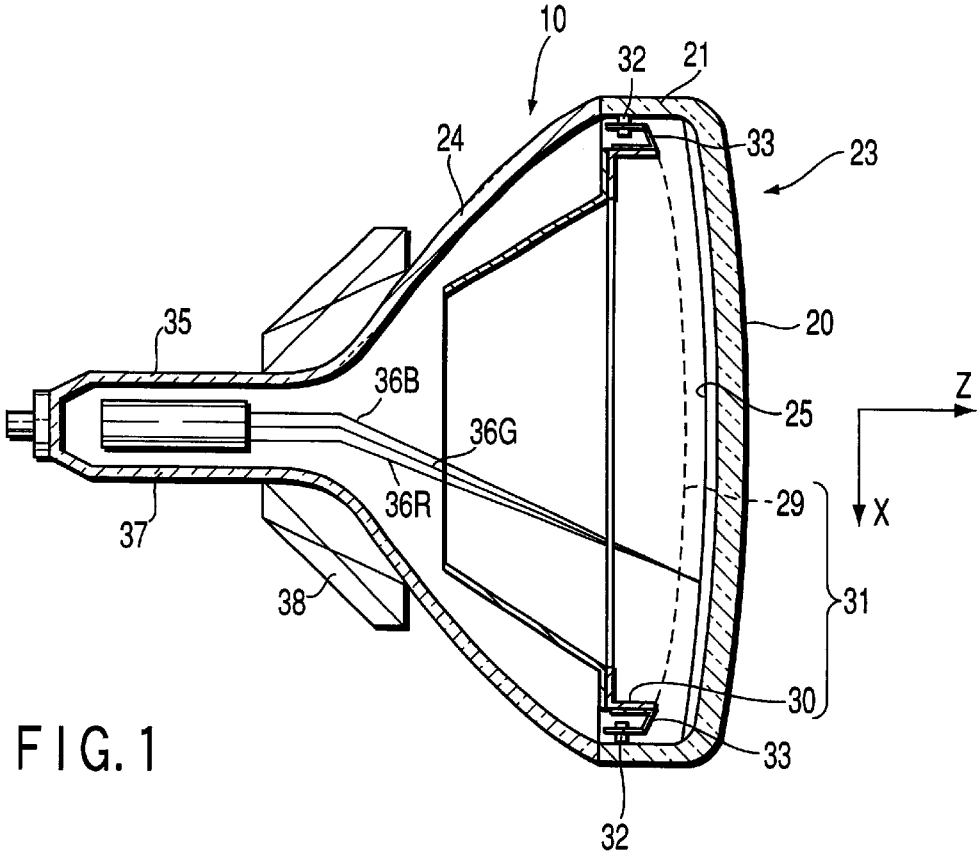
FIG. 1 is a cross-sectional view of a color cathode-ray tube (CRT) according to an embodiment of the present invention.
Figure 2:
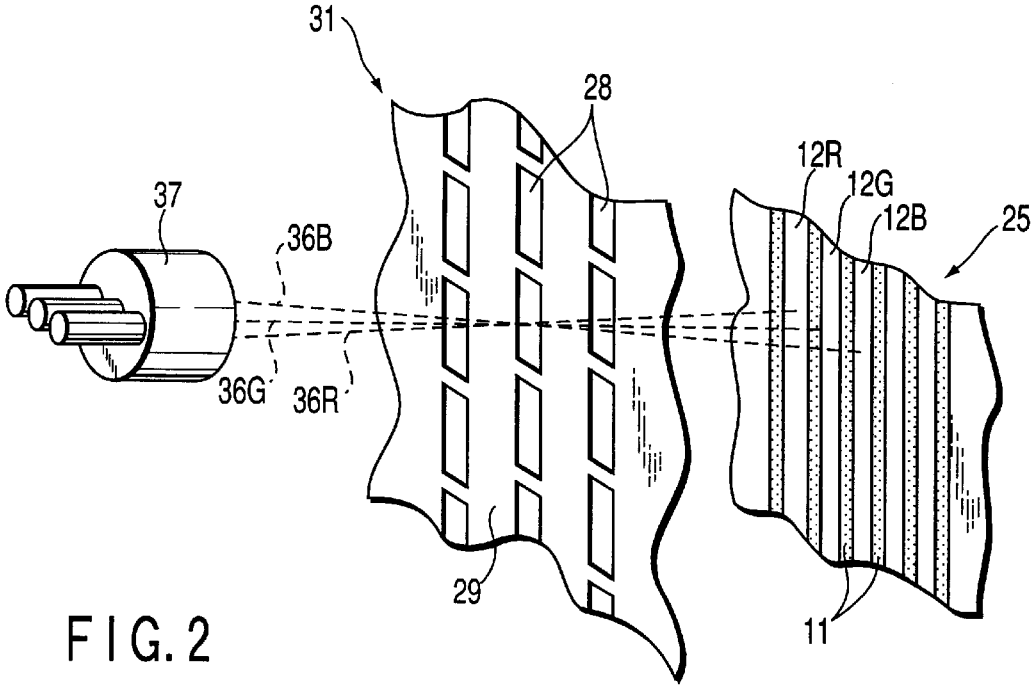
FIG. 2 is a perspective view schematically showing an electron gun, a shadow mask and a phosphor screen in the color CRT.

As is shown in FIG. 1, the color CRT has a vacuum envelope 10. The vacuum envelope 10 has a panel 23 and a funnel 24. The panel 23 has a substantially rectangular effective portion 20 with a curved surface, and a skirt portion 21 formed to stand at a peripheral area of the effective portion. The funnel 24 is coupled to the skirt portion 21. As is shown in FIGS. 1 and 2, a phosphor screen 25 is formed on an inner surface of the effective portion 20 of the panel 23. The phosphor screen 25 comprises black non-light-emission layers 11 and striped tricolor phosphor layers 12R, 12G and 12B interposed among the non-light-emission layers 11.

A substantially rectangular shadow mask 31 is arranged inside the panel 23 so as to face the phosphor screen 25. As is shown in FIGS. 1 through 3B, the shadow mask 31 comprises a substantially rectangular mask body 29 and a substantially rectangular mask frame 30 supporting a peripheral portion of the mask body 29. The effective portion 20 of the panel 23 and the shadow mask 31 both have a center 0 through which a tube axis X extends, and a long axis (X-axis) and a short axis (Y-axis) extending through the center O at right angles with each other.

The mask body 29 has a substantially rectangular curved effective surface 27 opposed to the phosphor screen 25. A number of electron beam passage apertures 28 are formed in the effective surface 27. The mask frame 30 attached to the peripheral portion of the mask body 29 has an L-shaped cross section. The shadow mask 31 is detachably supported on the panel 23 by engaging wedge-shaped elastic support members 33 attached to the respective corner portions of the mask frame 30 with stud pins 32 fixed to the respective corner portions of the skirt portion 21 of the panel 23.

On the other hand, an electron gun 37 for emitting three electron beams 36G, 36B and 36R is disposed within a neck 35 of the funnel 24. A deflecting device 38 is mounted on an outer periphery of the funnel 24.

In the color CRT with the above structure, three electron beams 36G, 36B and 36R emitted from the electron gun 37 are deflected by magnetic fields generated by the deflecting device 37. The deflected beams are horizontally and vertically scanned over the phosphor screen 25 through the shadow mask 31. Thus a color image is displayed.

In the above-described color CRT, the effective portion 20 of the panel 23 and the effective surface 27 of mask body 29 of shadow mask 31 are constructed as described below.

Specifically, the effective surface 27 of mask body 29 of shadow mask 31 has a curvature in the direction of its long axis X, which is set within a range of 0 to $3\times10^{-4}$ (1/mm), preferably 0 to $2\times10^{-4}$ (1/mm), over an area from the center O of the effective surface 27 to a middle portion of the effective surface 27. The curvature at a peripheral portion of the effective surface 27 is set to be greater than that at the middle portion thereof. Where a distance between the center O of effective surface 27 and a short-axis effective end is Lv, the curvature on the short axis Y of the effective surface 27 continuously varies along the short axis Y so as to gradually increase from the center O toward the short-axis effective end over an area extending from the center O to Lv·2/3.

Where the radius of curvature on long axis X of effective surface 27 near the center O is RmHC, the radius of curvature on short axis Y is RmVC and the radius of curvature on short axis Y of the effective surface near the short-axis(Y) effective end is RmVP, the effective surface 27 of mask body 29 is curved such that RmHC, RmVC and RmVP meet the following formulae:

$$O<RmVP/RmVC<0.6 \quad (1)$$

$$RmVC/RmHC<0.8 \quad (2)$$

Preferably, the effective surface 27 is curved such that RmHC, RmVC and RmVP meet the following formulae:

$$O<RmVP/RmVC<0.4$$

$$RmVC/RmHC<0.3$$

On the other hand, in consideration of enhancement of visibility and reduction in reflection of external light, the radius of curvature of the outer surface of the effective portion 20 of the panel 23 is set to be 10,000 mm or more, which is close to a level of a flat plane. Like the effective surface 27 of the mask body 29, the inner surface of the effective portion 20 has a curvature on long axis X which is set at about 0 to $2\times10^{-4}$ (1/mm) over an area from the center of effective portion 20 to a middle portion thereof. The curvature at a peripheral portion on the long axis is greater than that at a middle portion. Where a distance between the center O of the effective portion 20 and a short-axis effective end is L, the curvature on the short axis Y of the inner surface continuously varies along the short axis Y so as to gradually increase from the center O toward the short-axis effective end over an area extending from the center O of the effective portion 20 to L·2/3.

Where the radius of curvature on the long axis of the effective portion 20 near the center is RpHC, the radius of curvature on the short axis is RpVC and the radius of curvature on the short axis near the short-axis effective end is RpVP, the inner surface of the effective portion 20 of the panel is curved such that RpHC, RpVC and RpVP meet the following formulae:

$$O<RpVP/RpVC<0.6 \quad (3)$$

$$RpVC/RpHC<0.8 \quad (4)$$

Preferably, the inner surface of the effective portion 20 is curved such that RpHC, RpVC and RpVP meet the following formulae:

$$O<RpVP/RpVC<0.4$$

$$RpVC/RpHC<0.3$$

If the panel 23 and shadow mask 31 are constructed as described above, the visibility can be enhanced while the reflection of external light reduced. In addition, the quality of an image displayed on the phosphor screen 25 is improved. Deterioration in color purity due to doming of the shadow mask 31 at the time of operation of the color CRT can be reduced. Moreover, deterioration in color purity due to a beam landing error on tricolor phosphor layers, which results from deformation of the mask body 29 in the manufacturing process of the color CRT, can be reduced.

A description will now be given of a specific example of a color CRT having a panel with a diagonal dimension of 76 cm and an aspect ratio of 16:9.

EXAMPLE 1

Figure 4A:
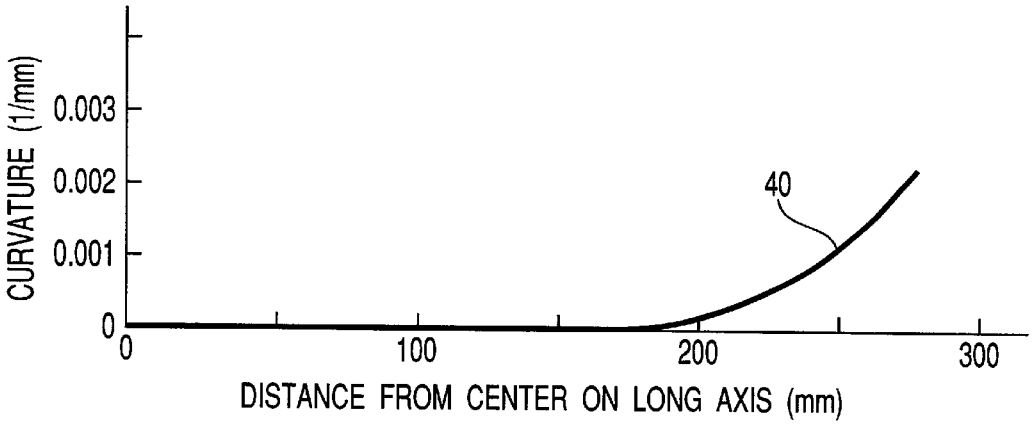
FIG. 4A shows a curvature on a long axis of an effective surface of the shadow mask, as plotted in the direction of the long axis.
Figure 4B:
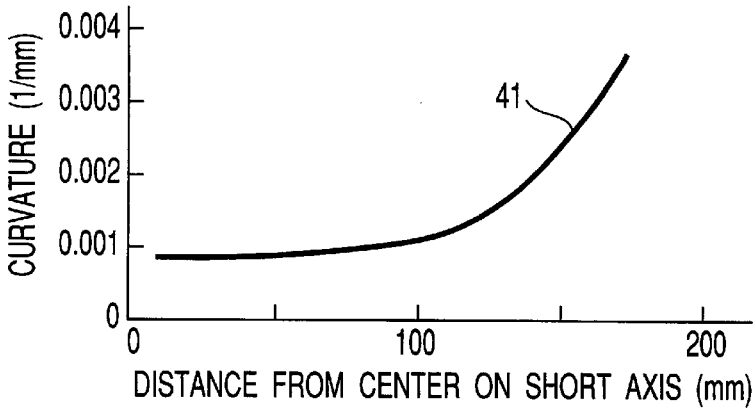
FIG. 4B shows a curvature on a short axis of the effective surface of the shadow mask, as plotted in the direction of the short axis.

In a color cathode-ray tube (CRT) according to Example 1, the effective surface 27 of the mask body 29 has a curvature on the long axis X, as plotted along the long axis in FIG. 4A, and a curvature on the short axis Y, as plotted along the short axis in FIG. 4B. As indicated by a curve 40 in FIG. 4A, the curvature on the long axis X of effective surface 27 varies along the long axis such that it is substantially zero from the center O of the effective surface 27 to a middle portion (near the center) at about 200 mm from the center O and it gradually increases from the middle portion towards the effective end on the long axis X.

On the other hand, as indicated by a curve 41 in FIG. 4B, the curvature on the short axis Y of effective surface 27 varies along the short axis smoothly and successively such that it is about 0.0008 (radius of curvature=about 1,300 mm) at the center O of the effective surface, about 0.001 (radius of curvature=about 1,000 mm) at a middle portion about 100 mm away from the center, and about 0.003 (radius of curvature=about 300 mm) at the effective end on the short axis Y. The curvature gradually increases from the center to the middle portion of the effective surface, and it further increases from the middle portion toward the short-axis effective end.

As regards the radius of curvature, RmHC, on long axis X of effective surface 27 near the center O, the radius of curvature, RmVC, on short axis Y, and the radius of curvature, RmVP, on short axis Y of the effective surface near the short-axis effective end, RmVP/RmVC is 0.23 and RmVC/RmHC is substantially zero and the above-stated formulae (1) and (2) are satisfied.

Where the effective surface 27 of mask body 29 is formed as described above, the curved-surface retention strength of the shadow mask 31 is enhanced and deformation of the effective surface of the mask body can be suppressed. As a result, deterioration in color purity due to a beam landing error, which results from deformation of the effective surface of the mask body, can be reduced. In addition, since the effective surface 27 has a continuous curved surface with no bending point b between the vicinity of center O and the vicinity of the periphery, there is no unnaturalness in a reflection image on the inner surface of the panel 23 and a color CRT capable of displaying a high-quality image can be constructed.

Specifically, as regards the shadow mask disclosed in Japanese Patent Application No. 10-199417, the radius of curvature on the long axis is infinite near the center along the long axis and the radius of curvature on the short axis is substantially constant along the short axis. As has been described above, with this shadow mask, almost satisfactory characteristics are obtained with respect to deterioration in color purity due to a beam landing error on the tricolor phosphor layers which results from doming, but characteristics relating to the curved-surface retention strength is not satisfactory. If the dimensions of the effective surface of the mask body are set as in this Example, the curved-surface retention strength can be increased and the deterioration in color purity due to deformation of the effective surface can be greatly reduced.

TABLE 1 below shows comparison results on beam landing shift amounts due to doming among conventional color CRTs incorporating a shadow mask having a mask body with a spherical effective surface, a shadow mask having a mask body with a cylindrical surface with a curvature in the long-axis (X) direction and a shadow mask having a mask body with a cylindrical surface with a curvature in the short-axis (Y) direction, and the shadow mask of present Example 1. TABLE 2 shows comparison results in simulation on deformation amount where a load of about 1 G was applied to the effective surfaces of the mask bodies of the above shadow masks. In each of the shadow masks shown in the Tables, the fall of a diagonal end portion with respect of the center of the effective surface of the mask body is set at 20 mm.

TABLE 1

| SHAPE OF EFFECTIVE SURFACE | BEAM LANDING SHIFT AMOUNT ($\mu$m) |
|---|---|
| (a) SPHERICAL | 189 |
| (b) CYLINDRICAL WITH CURVATURE IN LONG AXIS | 363 |
| (c) CYLINDRICAL WITH CURVATURE IN SHORT AXIS | 88 |
| (d) EXAMPLE 1 | 89 |

TABLE 2

| SHAPE OF EFFECTIVE SURFACE | CENTER (mm) | MIDDLE ON SHORT AXIS (mm) | MIDDLE ON LONG AXIS (mm) | MIDDLE ON DIAGONAL AXIS (mm) |
|---|---|---|---|---|
| (a) SPHERICAL | 0.200 | 0.192 | 0.175 | 0.173 |
| (b) CYLINDRICAL WITH CURVATURE IN LONG AXIS | 0.228 | 0.185 | 0.745 | 0.079 |
| (c) CYLINDRICAL WITH CURVATURE IN SHORT AXIS | 0.213 | 0.533 | 0.049 | 0.390 |
| (d) EXAMPLE 1 | 0.084 | 0.239 | 0.069 | 0.184 |

In TABLES 1 and 2, the shadow mask (c) is disclosed in the above-mentioned Japanese Patent Application No. 10-199417. As is clear from TABLE 1, the beam landing shift amount due to doming is greatly improved, compared to the shadow masks (a) and (b). In the case of the shadow mask (d) according to Example 1, the beam landing shift amount due to doming is substantially equal to that of the shadow mask (c).

Figure 5:
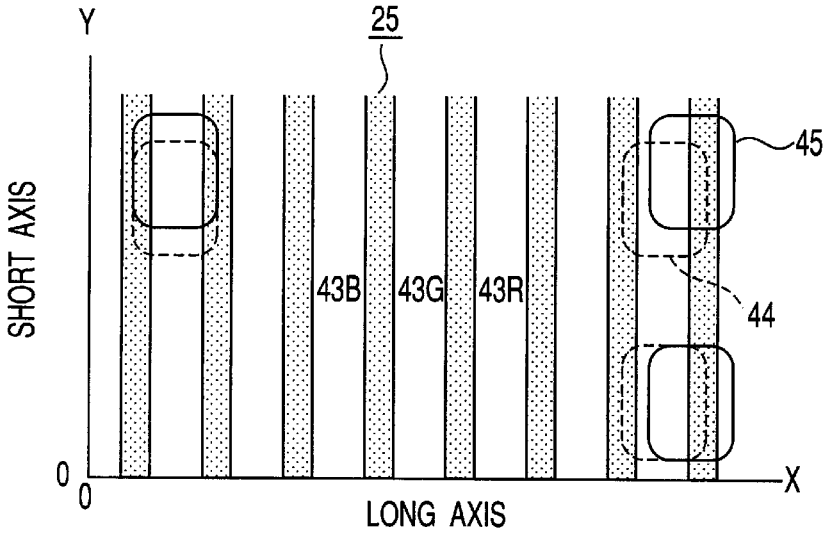
FIG. 5 is a view for describing a relationship between the phosphor screen with striped tricolor phosphor layers extending along the short axis and landing errors of electron beams.

As seen from TABLE 2, with the shadow mask (c), deformation in the long-axis direction does not easily occur, and deformation in the short-axis direction easily occurs. Accordingly, if the amount of deformation is equal, deterioration in color purity is reduced in the shadow mask (c), compared to the shadow masks (a) and (b), but the amount of deformation is not sufficiently small. On the other hand, in the shadow mask of Example 1, compared to the shadow mask (c), the amount of deformation in the short-axis direction is greatly reduced.

Where the effective surface has deformed, the influence on the beam landing error on the tricolor phosphor layers varies depending on the direction of deflection of electron beams. FIG. 5 shows a case where the tricolor phosphor layers 43B, 43G and 43R of the phosphor screen 25 are formed in stripes extending in the direction of short axis Y. A beam spot 44 is obtained when the effective surface of the mask body does not deform, and a beam spot 45 is obtained when the effective surface has deformed. The influence of the deformation of the effective surface upon the beam landing error, that is, the influence upon the deterioration in color purity, is least where the effective surface deforms in the short-axis direction.

Figure 6:
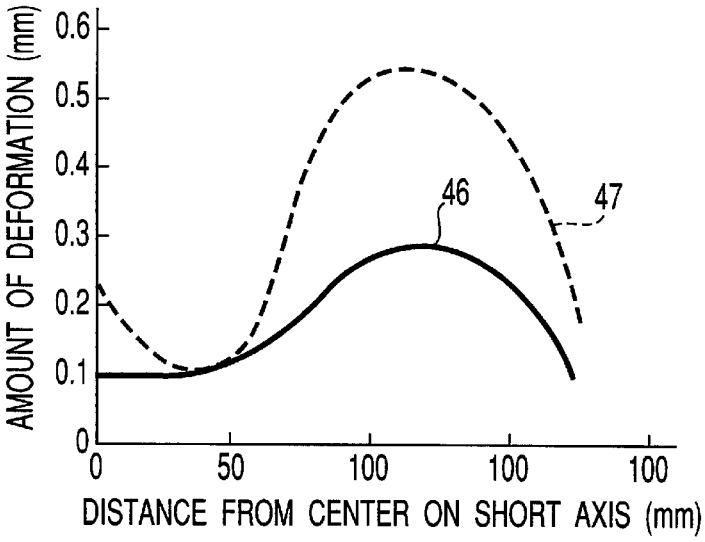
FIG. 6 is a graph comparing a deformation amount on the short axis of an effective surface of a mask body of a shadow mask according to Example 1 of the present invention and the deformation amount in the conventional shadow mask.

FIG. 6 shows comparison results on the amount of deformation in the short-axis direction when a load of 1 G was applied to the effective surface of the mask body of the shadow mask according to Example 1 (solid-line curve 46) and to the effective surface of the mask body of the shadow mask (c) (broken-line curve 47). It is understood from FIG. 6 that in the shadow mask of Example 1, compared to the shadow mask (c), the amount of deformation of the effective surface in the short-axis direction can be greatly reduced.

The curved shape of the effective surface 27 of mask body 29 of the shadow mask 31 with the above structure can be expressed by the following 6th-order function, where the amount of depression of a certain point on the short axis Y in respect of the center O is Zm and a distance from the center is Ym:

$$Zm=3.77\times10^{-4}ym^2+8.30\times10^{-11}\mathrm{Ym}^4+9.16\times10^{-9}ym^6$$

On the other hand, the panel 23 incorporated in the shadow mask 31 has the effective portion 20 whose outer surface is almost flat with a radius of curvature of 100,000 mm. The curved shape of the inner surface of the effective portion 20 is expressed by the following equation, where the amount of depression of a short-axis (Y) effective end in respect of the center O is Zp and a distance from the center is Yp:

$$Zp=4.33\times10^{-4}yp^2-9.32\times10^{-10}Yp^4+4.04\times10^{-14}yp^6$$

As has been described above, compared to the conventional shadow mask, in particular, the shadow mask wherein the curvature in the short-axis direction is constant near the center of the effective surface and the vicinity of the periphery has a lower constant curvature, the shadow mask of Example 1 has a reduced amount of deformation in the effective surface when a load is applied. In addition, no bending point is present between the vicinity of the center and the vicinity of the periphery of the effective surface. With use of this shadow mask, there is no unnaturalness in a reflection image on the inner surface of the panel and a color CRT capable of displaying a high-quality image can be constructed.

EXAMPLE 2

With the above-described shadow mask (c), the radius of curvature on the long axis is infinite near the center along the long axis of the effective surface, and the radius of curvature on the short axis is constant along the short axis. In this shadow mask, as indicated by the broken-line curve 47 in FIG. 6, when the load is applied, greater deformation occurs on a region relatively outside the middle point on the short axis.

Figure 7A:
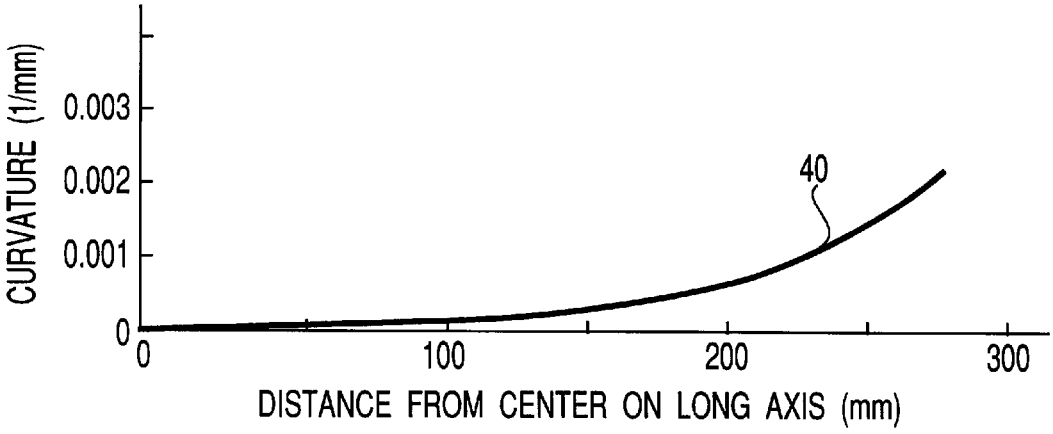
FIG. 7A is a graph showing a curvature on the long axis of an effective surface of a shadow mask according to Example 2 of the present invention, as plotted along the long axis.
Figure 7B:
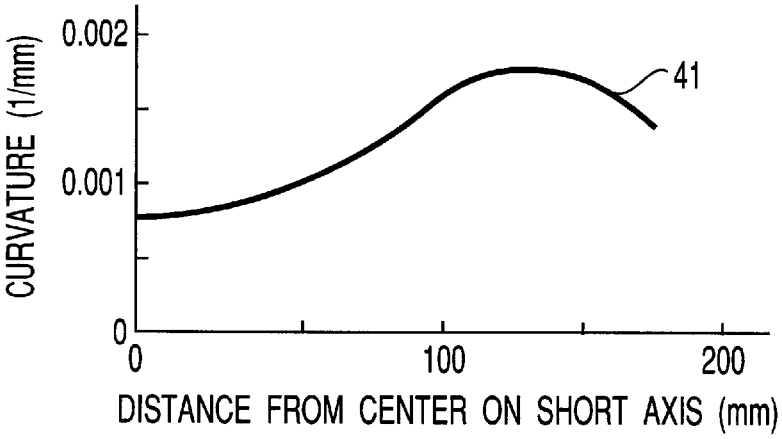
FIG. 7B is a graph showing a curvature on the short axis of the effective surface, as plotted along the short axis.

In Example 2 of the invention, as indicated by a curve 40 in FIG. 7A, the curvature on long axis X of the effective surface 27 of mask body 29 along the long-axis direction is made substantially equal to the curvature on the long axis along the long-axis direction in Example 1 shown in FIG. 4A. In addition, as indicated by a curve 41 in FIG. 7B, the curvature on short axis Y along the short-axis direction is made greater on a region comparatively outside the middle point in the short-axis direction of the effective surface. Thereby, deformation of the effective surface 27 can be effectively suppressed when a load is applied to the shadow mask.

Figure 3A:
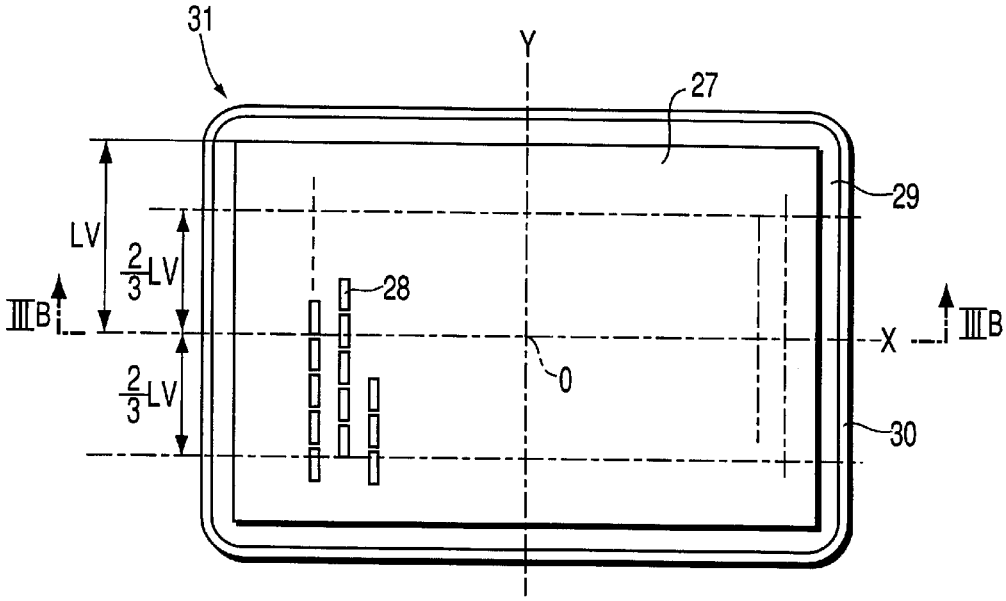
FIG. 3A is a plan view of the shadow mask.
Figure 3B:
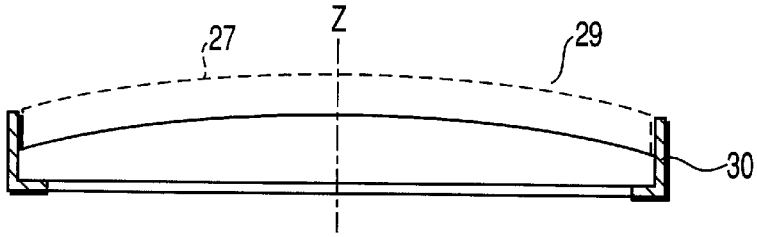
FIG. 3B is a cross-sectional view taken along line IIIB—IIIB in FIG. 3A.

Specifically, a relatively large curvature on long axis X is set on the effective surface 27 in the long-axis direction. In addition, as shown in FIG. 3A, where the distance between the center O of effective surface 27 and the short-axis (Y) effective end is Lv, the curvature on the short axis Y of effective surface 27 along the short-axis direction gradually increases from the center O toward the short-axis effective end over an area extending from the center O to Lv·2/3. The curvature of the effective surface 27 further varies successively and smoothly so as to decrease in the short-axis direction over an area from Lv·2/3 to the short-axis effective end. In this case, the curvature on the long axis in the long-axis direction is set at 9,000 mm at a point, which is 100 mm from the center of the effective surface 27 toward the long-axis effective end, and set at 2,000 mm at a point which is 200 mm from the center of the effective surface 27 toward the long-axis effective end.

In the shadow mask 31 with this structure, the beam landing error due to doming of the shadow mask is slightly greater than in the case of Example 1 but a sufficient curved-surface retention strength can be obtained. Thus the color CRT having substantially the same advantages as with the Example 1 can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube comprising:

a vacuum envelope having a panel with a substantially rectangular effective portion;

a phosphor screen formed on an inner surface of the effective portion; and a substantially rectangular shadow mask arranged to face the phosphor screen, wherein the shadow mask has a mask body and a substantially rectangular mask frame attached to a peripheral portion of the mask body, the mask body having a substantially rectangular curved effective surface opposed to the phosphor screen, and a number of electron beam passage apertures being formed in the effective surface, the shadow mask and the panel both have a center through which a tube axis extends, and a long axis and a short axis extending through the center at right angles with each other, and the effective surface of the mask body has a curvature in a direction of the long axis, which is set within a range of about 0 to $3\times10^{-4}$ (1/mm) over an area from a center of the effective surface to a middle portion of the effective surface in the direction of the long axis, a curvature at a peripheral portion in the direction of the long axis is set to be greater than that at the middle portion, and a curvature on the short axis in the direction of the short axis successively increases over a distance equal to at least two thirds of a distance between the center and an effective end of the short axis.

2. A color cathode-ray tube according to claim 1, wherein where a radius of curvature in the direction of the short axis near the center of the effective surface is RmVC and a radius of curvature in the direction of the short axis of the effective surface near the effective end of the short axis is RmVP, the effective surface satisfies the following relationship:

$$O<RmVP/RmVC<0.6.$$

3. A color cathode-ray tube according to claim 2, wherein the effective surface satisfies the following relationship:

$$0<RmVP/RmVC<0.4.$$

4. A color cathode-ray tube according to claim 1, wherein where a radius of curvature in the direction of the long axis near the center of the effective surface is RmHC and a radius of curvature in the direction of the short axis is RmVC, the effective surface satisfies the following relationship:

$$RmVC/RmHC<0.8.$$

5. A color cathode-ray tube according to claim 4, wherein the effective surface satisfies the following relationship:

$$RmVC/RmHC<0.3.$$

6. A color cathode-ray tube according to claim 1, wherein the radius of curvature in the direction of the long axis of the effective surface of the mask body is set in a range of about 0 to $2\times10^{-4}$ (1/mm) over an area from the center of effective surface to a middle portion in the direction of the long axis.

7. A color cathode-ray tube according to claim 1, wherein the inner surface of the effective portion of the panel has a curvature in a direction of the long axis, which is set within a range of about 0 to $0.3\times10^{-4}$ (1/mm) over an area from a center of the effective portion to a middle portion of the effective portion in the direction of the long axis, a curvature at a peripheral portion in the direction of the long axis is set to be greater than that at the middle portion, and a curvature on the short axis in the direction of the short axis successively increases over a distance equal to at least two thirds of a distance between the center and an effective end of the short axis.

8. A color cathode-ray tube according to claim 7, wherein where a radius of curvature in the direction of the short axis near the center of the inner surface of the effective portion is RpVC and a radius of curvature in the direction of the short axis of the effective surface near the effective end of the short axis is RpVP, the effective surface satisfies the following relationship:

$$O<RpVP/RpVC<0.6.$$

9. A color cathode-ray tube according to claim 8, wherein the effective surface satisfies the following relationship:

$$O<RpVP/RpVC<0.4.$$

10. A color cathode-ray tube according to claim 7, wherein where a radius of curvature in the direction of the long axis near the center of the inner surface of the effective portion is RpHC and a radius of curvature in the direction of the short axis is RpVC, the effective surface satisfies the following relationship:

$$RpVC/RpHC<0.8.$$

11. A color cathode-ray tube according to claim 10, wherein the effective surface satisfies the following relationship:

$$RpVC/RpHC<0.3.$$

12. A color cathode-ray tube according to claim 7, wherein the radius of curvature in the direction of the long axis of the effective surface of the mask body is set in a range of about 0 to $2\times10^{-4}$ (1/mm) over an area from the center of effective surface to a middle portion in the direction of the long axis.

* * * * *